US010192693B2

(12) United States Patent
Herold et al.

(10) Patent No.: US 10,192,693 B2
(45) Date of Patent: Jan. 29, 2019

(54) TAP CHANGER, FORCE-STORAGE UNIT, AND CONTROLLED-BACKLASH COUPLING THEREBETWEEN

(71) Applicant: Maschinenfabrik Reinhausen GmbH, Regensburg (DE)

(72) Inventors: Stefan Herold, Regensburg (DE); Klaus Hoepfl, Maxhuette-Haidhof (DE); Gregor Wilhelm, Regensburg (DE); Abraham Ahmadi, Falkenstein (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 15/550,784

(22) PCT Filed: Mar. 2, 2016

(86) PCT No.: PCT/EP2016/054410

§ 371 (c)(1),
(2) Date: Aug. 13, 2017

(87) PCT Pub. No.: WO2016/146387

PCT Pub. Date: Sep. 22, 2016

(65) Prior Publication Data

US 2018/0040434 A1 Feb. 8, 2018

(30) Foreign Application Priority Data

Mar. 17, 2015 (DE) ..... 10 2015 103 928

(51) Int. Cl.
*H01H 9/00* (2006.01)
*H01H 3/30* (2006.01)

(52) U.S. Cl.
CPC ..... *H01H 9/0027* (2013.01); *H01H 3/3015* (2013.01); *H01H 3/3052* (2013.01); *H01H 3/3031* (2013.01); *H01H 2235/016* (2013.01)

(58) Field of Classification Search
CPC ..... H01H 9/0027–3/3015; H01H 3/30; H01H 3/42
See application file for complete search history.

(56) References Cited

U.S. PATENT DOCUMENTS 5,101,675 A * 4/1992 Lauterwald ..... H01H 9/0027 185/40 R
5,195,632 A * 3/1993 Lauterwald ..... H01H 9/0027 200/324

(Continued)

FOREIGN PATENT DOCUMENTS

EP 0355814 A 2/1990
GB 2014794 A 8/1979

*Primary Examiner* — Vanessa Girardi
(74) *Attorney, Agent, or Firm* — Andrew Wilford

(57) ABSTRACT

An energy accumulator (15) for or in an on-load tap changer (10) comprises a motor (11) with an output shaft (12) and a load diverter switch (13) with an input shaft (14), comprising an elastic storage element (17);

a transmission coupled to the storage element (17) and having an input hub (201) that can be rotationally fixed to the output shaft (12);

an output hub (231) that can be rotationally fixed to the input shaft (14); and a variable transmission (20, 21) interposed between the input hub (201) and the storage element (17).

12 Claims, 9 Drawing Sheets

(56) References Cited

U.S. PATENT DOCUMENTS

| | | | |
|---|---|---|---|
| 6,838,629 | B2 | 1/2005 | Basertl |
| 7,518,075 | B2 | 4/2009 | Wrede |
| 7,562,218 | B2 | 7/2009 | Kirkup et al. |
| 8,119,939 | B2 | 2/2012 | Albrecht |
| 8,748,758 | B2 | 1/2014 | Hoepfl |
| 8,747,758 | B2 | 6/2014 | Davydov et al. |
| 2014/0190803 | A1 | 7/2014 | Jatta |
| 2015/0001053 | A1 | 1/2015 | Miyamoto |

* cited by examiner

TAP CHANGER, FORCE-STORAGE UNIT, AND CONTROLLED-BACKLASH COUPLING THEREBETWEEN

CROSS REFERENCE TO RELATED APPLICATIONS

This application is the US-national stage of PCT application PCT/EP2016/054410 filed 2 Mar. 2016 and claiming the priority of German patent application 102015103928.1 itself filed 17 Mar. 2015 and PCT patent application PCT/EP2016/054410 itself filed 2 Mar. 2016.

FIELD OF THE INVENTION

The invention relates to an force-storage unit for an on-load tap changer and to an on-load tap changer with force-storage unit.

BACKGROUND OF THE INVENTION

An energy accumulator, frequently also referred to as a force-storage unit, serves in an on-load tap changer with an output shaft, an input shaft, and a load diverter switch for converting a continuous, slow rotation of the output shaft being driven by a motor at a constant rotational speed into an abrupt, rapid rotation of the input shaft driving the load diverter switch. Numerous force-storage units are already known that enable the abrupt rotation of the input shaft by means of a storage spring. The principle is always the same: the output shaft driven by the motor at a constant rotational speed loads the storage spring to a maximum point, and, after exceeding this maximum point, the storage spring suddenly unloads and thereby abruptly drives the input shaft.

DE 28 06 282 [GB 2,014,794], EP 0 355 814, DE 10 2005 027 524 [U.S. Pat. No. 7,518,075], DE 102005 027 527 [U.S. Pat. No. 7,652,218], DE 10 2010 020 130 [US 2014/0190803], and EP 2 760 034 [US 2015/0001053] each describe an on-load tap changer with an force-storage unit comprising a storage spring, a drive train, a frame for the drive train, an eccentric, a loading slide and a release slide. The drive train comprises an input hub and an output hub. Due to these slides, such force-storage units are also referred to as slide force-storage units.

The output shaft is rotationally fixed to the input hub in these known on-load tap changers. The input hub is rotationally fixed to the eccentric. The eccentric is fixedly connected to the loading slide. The storage spring supports itself between the loading slide and the release slide. The loading slide and the release slide can move relative to the frame along a linear guide independently from each other back and forth between two end positions. The release slide is fixedly connected to the output hub.

The eccentric together with the loading slide consequently form a tensioning element formed such that it engages at the storage element for tensioning and then tensions the storage element upon rotation of the input hub, and the release slide forms a relaxing element formed such that it engages at the storage element for driving the output hub and then drives the output hub upon relaxation of the storage element.

DE 102006 008 338 [U.S. Pat. No. 8,119,939] and DE 102009 034 627 [U.S. Pat. No. 8,748,758] each describe an on-load tap changer with an force-storage unit comprising a storage spring, a drive train, a frame for the drive train, a drive element in the form of a gear with two axially protruding stop surfaces and a crank with a crankpin. The drive train comprises an input hub and an output hub. Due to the crank, such force-storage units are also referred to as crank force-storage units.

The output shaft is rotationally fixed to the input hub in these known on-load tap changers. The input hub is rotationally fixed to the drive element. The drive element and the crank can rotate relative to each other back and forth between a first end position and a second end position. The stop surfaces correspond with the crank in such a manner that the first stop surface is in contact with the first side of the crank in the first end position, and the second stop surface is in contact with the second side of the crank in the second end position, with these sides being located opposite to each other. Consequently, the drive element is fixedly connected to the crank in these end positions. The storage spring is rotatably linked with its free end to the crankpin and pivotably supports itself with a fixed end on the frame. The free end can move relative to the fixed end along a linear guide back and forth between two end positions. The crank is coupled to the output hub.

The crank together with the drive element consequently form a tensioning element formed such that it engages at the storage element for tensioning and then tensions the storage element upon rotation of the input hub, and the crank forms a relaxing element formed such that it engages at the storage element for driving the output hub and then drives the output hub upon relaxation of the storage element.

SUMMARY OF THE INVENTION

According to a first aspect of the invention, there is provided an force-storage unit for or in an on-load tap changer having a motor with an output shaft and a load diverter switch with an input shaft, the force-storage unit comprising

- an elastic storage element;
- a drive train coupled to the storage element and having
  - an input hub that can be rotationally fixed to the output shaft;
  - an output hub that can be rotationally fixed to the input shaft; and
  - a variable transmission element or a variable transmission interposed between the input hub and the storage element.

A variable transmission is here exemplarily understood as a transmission with a variable ratio, that is to say that its transmission ratio depends on the angular position of the input hub or on the angular position of its input side coupled and, in particular, rotationally fixed to the input hub. The drive train can be formed, in particular, such that the transmission ratio upon rotation of the input hub from a first angular position into a second angular position becomes greater or smaller or changes sign or remains the same or is infinite.

The transmission ratio of the drive train is then exemplarily defined as u=vE:vA, where vE is the input velocity at which the input side of the transmission coupled to the input hub moves, and vA being the output velocity at which the output side of the transmission coupled to the storage element moves. If the input side and the output side of the transmission, for example, are rotatable, then the transmission can also be exemplarily expressed by u=nE;nA, with nE being the input rotational speed of the input side, and with nA being the output rotational speed of the output side. Consequently, a great or, as the case may be, a small transmission ratio u implies a low or, as the case may be, a high output velocity vA=vE;u.

The transmission of the proposed force-storage unit enables an oscillating pivot movement of the output hub between its first and second angular position independently from the direction of rotation of the input hub. An oscillating pivot movement in this context is to be understood such that the output hub first rotates in a first direction from a predetermined first angular position into a predetermined second angular position when the input hub is rotated by a predetermined differential angle in a first direction from a predetermined first angular position, and that the output hub rotates back in an opposite, second direction from its second into its first angular position when subsequently the input hub is either rotated back in an opposite, second direction into its first angular position or rotated further by the differential angle in the first direction.

Each proposed force-storage unit preferably comprises a tensioning element formed such that it engages at the storage element for tensioning and then tensions the storage element upon rotation of the input hub;

a relaxing element formed such that it engages at the storage element for driving the output hub and then drives the output hub upon relaxation of the storage element;

where the transmission is formed such that it follows up or can follow up the tensioning element to the relaxing element at a desired and/or predetermined velocity upon relaxation and/or upon driving of the output hub; and/or re-presses or can re-press the relaxing element upon relaxation and/or upon driving of the output hub.

Upon relaxation and/or upon driving of the output hub, the transmission in this case enables following up the tensioning element relative to the relaxing element at a desired and/or predetermined velocity that can be, in particular, greater than the velocity during tensioning.

In the instance of defect or blockage or obstruction of the storage element, or in the instance of difficult operating conditions of the on-load tap changer in comparison to the normal operating conditions, or in the instance of overload situations, it is possible that the relaxation and/or the driving of the output hub is carried out slower than under normal operating conditions and even so slow that the tensioning element closes in on the relaxing element and engages at the storage element, much like during tensioning. In this case, the transmission enables re-pressing the relaxing element by the input hub driving the output hub directly and undelayed by way of the tensioning element and the relaxing element.

The tensioning element and the relaxing element can be formed in any manner as required, for example as in a slide force-storage unit or as in a crank force-storage unit.

Each proposed force-storage unit preferably comprises at least one crank coupled to the storage element and to the transmission.

In particular, the crank forms at least a part of the tensioning element and/or at least a part of the relaxing element.

The proposed force-storage unit can be formed in any manner as required and, for example, comprise at least one or no additional elastic storage element and/or at least one or no additional transmission and/or at least one or no additional transmission.

Each storage element can be formed in any manner as required, for example as screw tension spring or helical compression spring or gas pressure spring or elastomer spring.

Each transmission can be formed in any manner as required and, for example, comprise at least one transmission with irregular and/or adjustable transmission preferentially formed as cam transmission or coupling transmission or stepping transmission or stepless transmission or CVT (Continuously Variable Transmission) or hydraulic transmission or gear pair of two elliptical gears.

Preferably, it is provided that the transmission is formed such that it tensions the storage element upon rotation of the input hub in a first direction from a predetermined first angular position into a predetermined second angular position, and the output hub meanwhile stands still;

the storage element is formed such that it relaxes upon rotation of the input hub in this direction from the second angular position into a predetermined third angular position, and the output hub meanwhile rotates from a first angular position into a second angular position.

During this rotation from the first into the second angular position, the output hub remains, in particular, in its first angular position.

Preferably, it is provided that the transmission is formed such that the transmission ratio of the transmission upon rotation of the input hub in this direction from the second into the third angular position and/or upon relaxation is smaller than during tensioning.

Preferably, it is provided that the transmission is formed such that the transmission ratio of the transmission upon rotation of the input hub in this direction from the first into the second angular position is greater than a predetermined threshold value; and/or the transmission ratio of the transmission upon rotation of the input hub in this direction from the second into the third angular position is smaller than this threshold value or than a predetermined other threshold value.

Preferably, it is provided that the transmission is formed such that it blocks the output hub upon rotation of the input hub in this direction from the third angular position into a predetermined fourth angular position;

and/or the transmission is formed such that the transmission ratio of the transmission upon this rotation from the third into the fourth angular position is infinite.

During this rotation, the transmission blocks the output hub, in particular, in its second angular position.

Preferably, it is provided that the transmission is formed such that it does not tension the storage element upon rotation of the input hub in this direction from a predetermined fifth angular position before the first angular position, into the first angular position, and the output hub meanwhile stands still.

During this rotation, the output hub remains, in particular, in its first angular position.

Preferably, it is provided that the transmission is formed such that it blocks the output hub upon rotation of the input hub in this direction from the fifth angular position into a predetermined intermediate angular position between the fifth and the first angular position;

and/or the transmission is formed such that the transmission ratio of the transmission is infinite upon this rotation from the fifth angular position into the intermediate angular position.

During this rotation, the transmission blocks the output hub, in particular, in its first angular position.

Preferably, it is provided that the transmission is formed such that the transmission ratio of the transmission upon rotation of the input hub in this direction from the fifth angular position or from a predetermined intermediate angular position between the fifth and the first angular position, into the first angular position is smaller than during tensioning.

Preferably, it is provided that the transmission and the storage element are formed such that together they rotate or can rotate the output hub from its first angular position or from an intermediate angular position between its first and second angular position, into its second angular position upon rotation of the input hub in this direction from the second angular position into the third angular position;

or the transmission is formed such that instead of the storage element, the transmission rotates or can rotate the output hub from its first angular position or from an intermediate angular position between its first and second angular position, into its second angular position upon rotation of the input hub in this direction from the second into the third angular position.

Preferably, it is provided that the transmission is formed such that it prevents the output hub from being able to depart from its second angular position by more than a predetermined deviation angle upon rotation of the input hub in this direction and between the second and third angular position.

Preferably, it is provided that the transmission comprises at least one cam disk having at least one cam and the input hub;

at least one cam follower that follows the cam;

and/or the transmission comprises an input gear with a rotation axis, which input gear supports the cam follower radially offset from the rotation axis; and/or an output gear having the output hub and coupled to the storage element; and/or a first, in particular, freewheel-type coupling with a predetermined first angular backlash, which coupling is interposed between the input gear and the storage element; and/or a second, in particular, freewheel-type coupling with a predetermined second angular backlash, which coupling is interposed between the storage element and the output gear.

Both the input gear and the output gear can be replaced by another suitable gear element if required, for example by a sprocket wheel or a belt pulley.

Preferably, it is provided that the transmission comprises at least one locking mechanism coupled to the output hub and, in particular, to the output gear;

the locking mechanism is formed such that it prevents the output hub from being able to depart from its second angular position by more than the deviation angle and/or toward its first angular position upon rotation of the input hub in this direction and between the second and third angular position; and/or prevents the output hub from being able to depart from its second angular position toward its first angular position when the output hub is in the second angular position; and/or prevents the output hub from being able to depart from an intermediate angular position toward its first angular position when the output hub is in this intermediate position between its first and second angular position; and/or prevents the output hub from remaining in its intermediate angular position upon rotation of the output hub from its second into its first angular position.

Preferably, it is provided that the transmission comprises a first gear or "A" gear that meshes with the input gear; and/or a second gear or "B" gear that is, in particular, coupled with the "A" gear, in particular, by way of the first coupling; and/or a third gear or "C" gear that meshes, in particular, with the "B" gear; and/or a fourth gear or "D" gear that meshes with the output gear and is coupled, in particular, with the "C" gear, in particular, by way of the second coupling.

Each of this gears can be replaced by another suitable gear element if required, for example by a sprocket wheel or a belt pulley.

Each proposed force-storage unit preferably comprises at least one crank coupled to the storage element and/or to the "C" gear.

In particular, the crank forms at least a part of the tensioning element and/or at least a part of the relaxing element.

Preferably, it is provided that the transmission comprises at least one release mechanism coupled, in particular, to the "B" gear;

the release mechanism is formed such that it releases the locking mechanism upon rotation of the input hub in this direction and when the input hub is located in the second angular position or between the second and third angular position.

Preferably, it is provided that the cam is formed such that each of the particular movements of the input gear run oppositely to each other upon rotation of the input hub in the first direction from the fifth into the fourth angular position and upon rotation of the input hub in an opposite, second direction from the fourth into the fifth angular position; and/or the cam is formed such that each of the particular movements of the input gear run oppositely to each other upon rotation of the input hub in the first direction from the fifth into the fourth angular position and upon rotation of the input hub in the first direction by the same differential angle from the fourth angular position; and/or the cam is in itself closed; and/or the cam is formed such that the differential angle between the fourth and fifth angular position is 180° or 90° or 60° or 45° or a whole-number fraction of 180°.

According to a second aspect of the invention, there is proposed an on-load tap changer comprising a motor with an output shaft;

a load diverter switch with an input shaft;

an force-storage unit formed according to the first aspect; wherein the input hub is rotationally fixed to the output shaft;

the output hub is rotationally fixed to the input shaft.

The proposed on-load tap changer can be formed in any manner as required and comprise, for example, at least one or no additional motor and/or at least one or no additional load diverter switch and/or at least one or no additional force-storage unit.

Each motor can be formed in any manner as required, for example as motor with a constant or unchangeable or unregulated rotational speed.

It is preferably provided that the on-load tap changer comprises at least one selector with a selector drive shaft rotationally fixed to the output shaft or that is the output shaft. The selector preferentially comprises at least two movable moving contacts that are rotationally fixed to the selector drive shaft The explanations and exemplifications regarding one of the aspects of the invention, in particular regarding individual features of this aspect, also apply correspondingly for the other aspects of the invention.

BRIEF DESCRIPTION OF THE DRAWING

In the following, embodiments of the invention are exemplified and explained in detail by means of the attached drawings. The individual features thereof are, however, not limited to the individual embodiments but can be connected and/or combined with individual features described further above and/or with individual features of other embodiments. Each example in the illustrations is provided by way of explanation, not limitation of the invention. The figures show as follows.

SPECIFIC DESCRIPTION OF THE INVENTION

Figure 1:
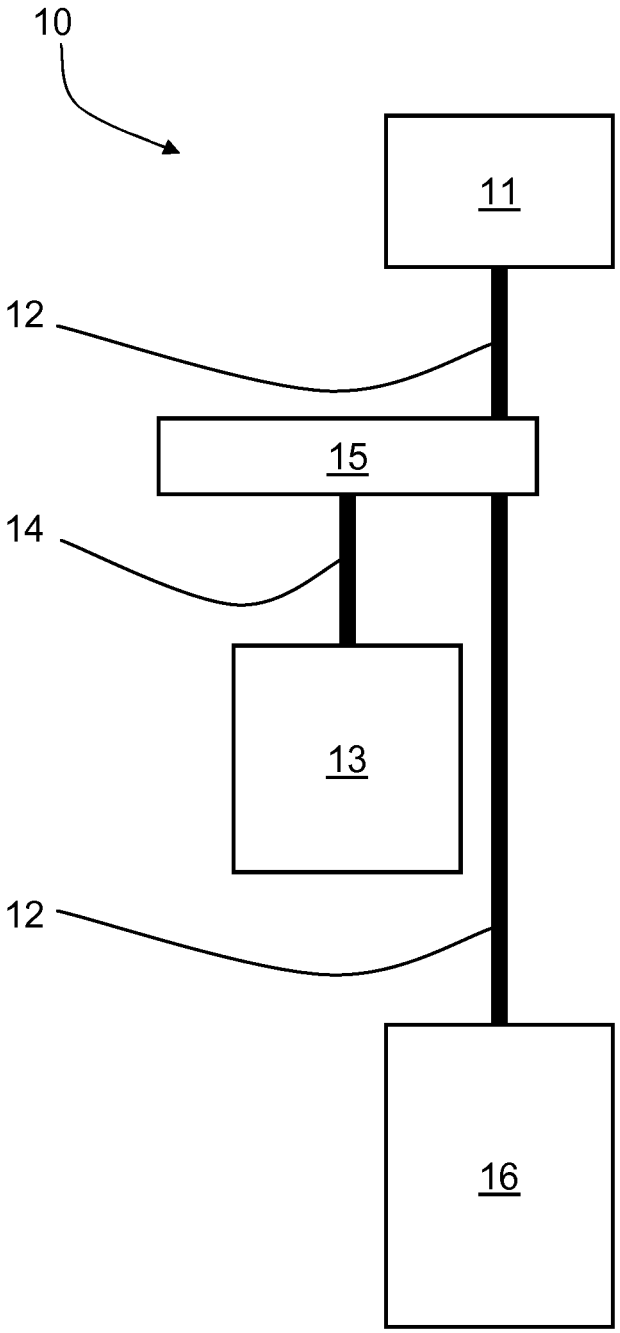
FIG. 1 a preferred embodiment of a on-load tap changer with an force-storage unit.
Figure 2:
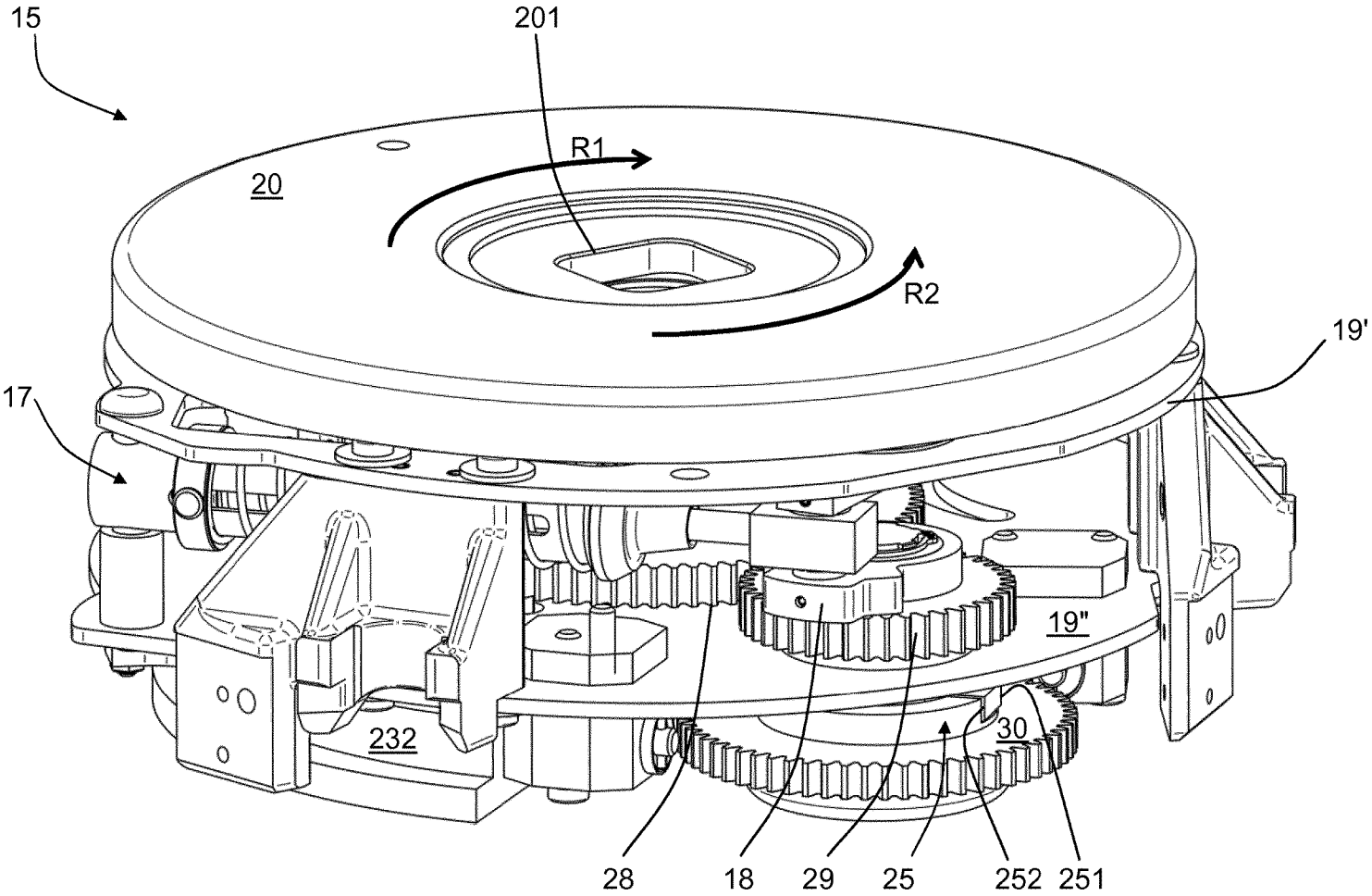
FIG. 2 a first view of a preferred embodiment of the force-storage unit of FIG. 1 with a locking mechanism in a first embodiment.
Figure 3:
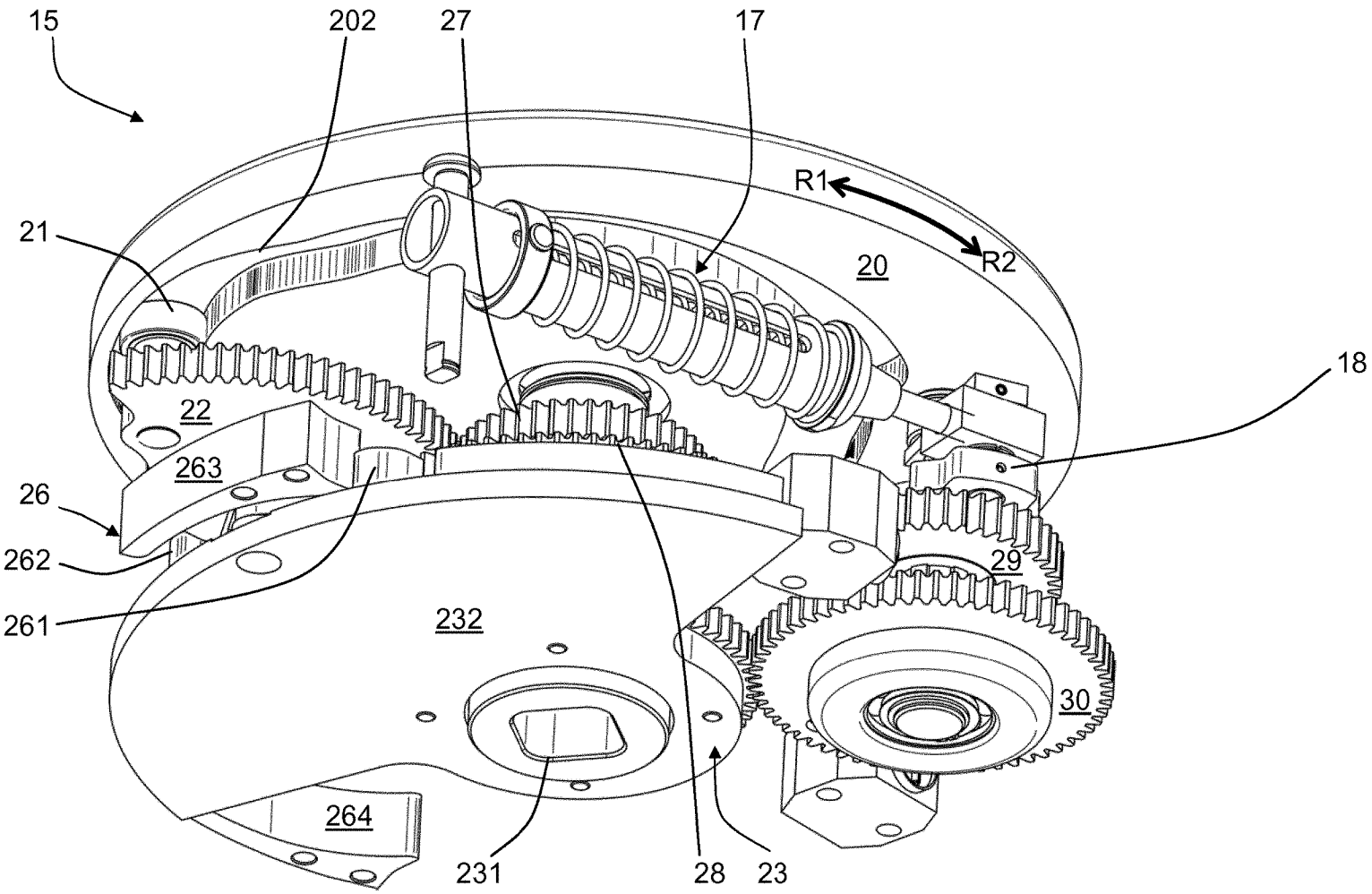
FIG. 3 a second view of the force-storage unit from FIG. 2.

In FIG. 1, a preferred embodiment of a embodiment of a on-load tap changer is 10 schematically illustrated, which exemplarily comprises a motor 11 with an output shaft 12, a load diverter switch 13 with an input shaft 14, an force-storage unit 15, and a selector 16. The load diverter switch 13 and the selector 16 are formed in the know manner and are therefore not illustrated in further detail. The selector 16 comprises a plurality of fixed contacts (not illustrated) and two movable moving contacts (not illustrated), and it is coupled to the output shaft 12 for driving the moving contacts. The load diverter switch 13 comprises a movable switch contact unit (not illustrated), and it is coupled to the input shaft 14 for driving the switch contact unit. By way of the force-storage unit 15, the input shaft 14 is coupled to the output shaft 12 that the motor 11 drives at a constant rotational speed upon a switching process of the on-load tap changer 10.

A preferred embodiment of the force-storage unit 15 is schematically illustrated in different views in FIG. 2, FIG. 3, FIG. 4, FIG. 5, and FIG. 6. The force-storage unit 15 exemplarily comprises a transmission, an elastic storage element 17, a crank 18 that couples the storage element 17 to the transmission, and a frame (not illustrated in FIG. 3, 4, 5) with an upper and a lower frame plate 19', 19" and with struts that connect the frame plates 19 to each other. The storage element 17 is pivotably mounted with a fixed end (on the left in FIG. 2) to the frame plates 19, and it is rotatably mounted with an oppositely located, movable end (on the right in FIG. 2) to the crank 18.

The transmission exemplarily comprises a cam disk 20 (not illustrated in FIG. 5) with an input hub 201 and with a groove-shaped cam 202 (FIG. 3) in its underside, a cam follower 21 (FIG. 3) following the cam 202, an input gear 22 with a rotation axis 221, an output gear 23 with an output hub 231 and a flywheel 232, a first and second coupling 24, 25 (FIG. 2, 5, 6), a locking mechanism 26 in a first embodiment with a first and a second pawl 261, 262 and with a first and a second latching nose 263, 264, an "A" gear 27, a "B" gear 28, a "C" gear 29, a "D" gear 30, and a release mechanism with a first and a second release bolt 31', 31".

The input hub 201 is rotationally fixed to the output shaft 12 (not illustrated). The output hub 231 is rotationally fixed to the input shaft 14 (not illustrated). The input gear 22 supports the cam follower 21 radially offset from the rotation axis 221 and projects upward into the cam 202. Cam disk 20 and cam follower 21 together form a cam transmission that constitutes a variable transmission interposed between input hub 201 and storage element. The "A" gear 27 meshes with the input gear 22 The "B" gear 28 is coupled with the "A" gear 27 by way of the first coupling 24. The "C" gear 29 meshes with the "B" gear 28. The "D" gear 30 is coupled with the "C" gear 29 by way of the second coupling 25, and it meshes with the output gear 23. The crank 18 is rotationally fixed to the "C" gear 29. The input gear 22 is thus coupled by way of "A" gear 27, first coupling 24, "B" gear 28, "C" gear 29, and crank 18 to the storage element 17. The output gear 23 is thus coupled by way of "D" gear 30, second coupling 25, "C" gear 29, and crank 18 to the storage element 17.

The output gear 23 is located below the lower frame plate 19", and the flywheel 232 is fastened to the underside of the toothing of the output gear 23. Each pawl 261, 262 is pivotably mounted radially outside of the toothing on the upper side of the flywheel 232 and has a pawl claw at its radially outer free end for seizing the assigned latching nose 263, 264 upon engagement, whereas its radially inner free end serves as stop for the assigned release bolt 31', 31" upon disengagement. The latching noses 263, 264 are fastened radially outside of the pawls 261, 262 to the underside of the lower frame plate 19" and each have a shallowly radially inwardly running contact surface and a sharply radially outwardly running latching surface that adjoins the radially inner end of the contact surface. The release bolt 31', 31" are fastened to the "B" gear 28 and project through an arc-shaped slot in the lower frame plate 19" downward to a level of the assigned pawl 261, 262. By a suitable rotation of the "B" gear 28, each release bolt 31', 31" can be advanced against the inner free end of the assigned pawl 261, 262 for disengagement, and its pawl claw can pivot radially inward away from each particular latching nose 263, 264 against the preload force of an assigned preload spring that supports itself on the flywheel 232.

Figure 7:
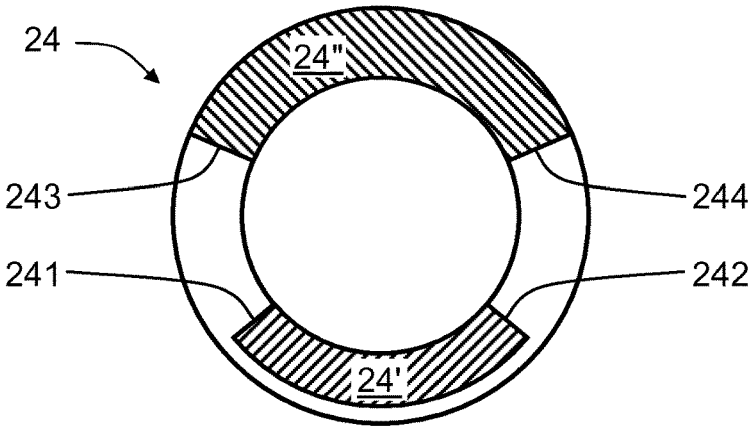
FIG. 7 a sectional view of an exemplary embodiment of a first coupling for the force-storage unit.
Figure 8:
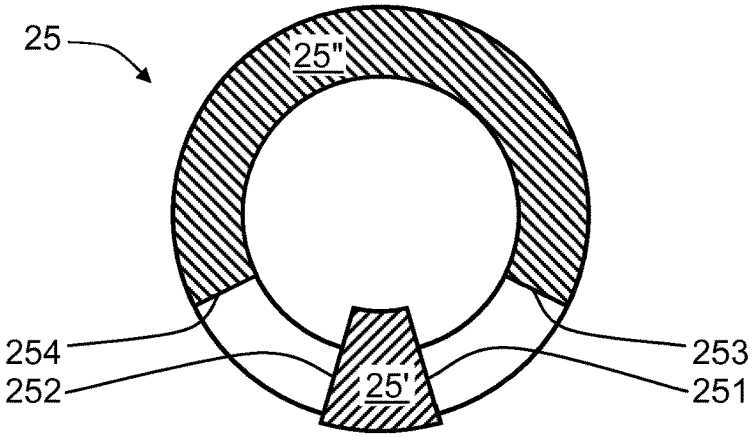
FIG. 8 a sectional view of an exemplary embodiment of a second coupling for the force-storage unit.

In FIG. 7 and FIG. 8, exemplary embodiments of the first or, as the case may be, of the second coupling 24, 25 are schematically illustrated in a cross section at a right angle to its appropriate rotational axis. The couplings 24, 25 are each formed freewheel-type and in the manner of a claw coupling, and they each have a predetermined first or, as the case may be, second angular backlash that allows a correspondingly limited freewheel in each direction of rotation.

Figure 5:
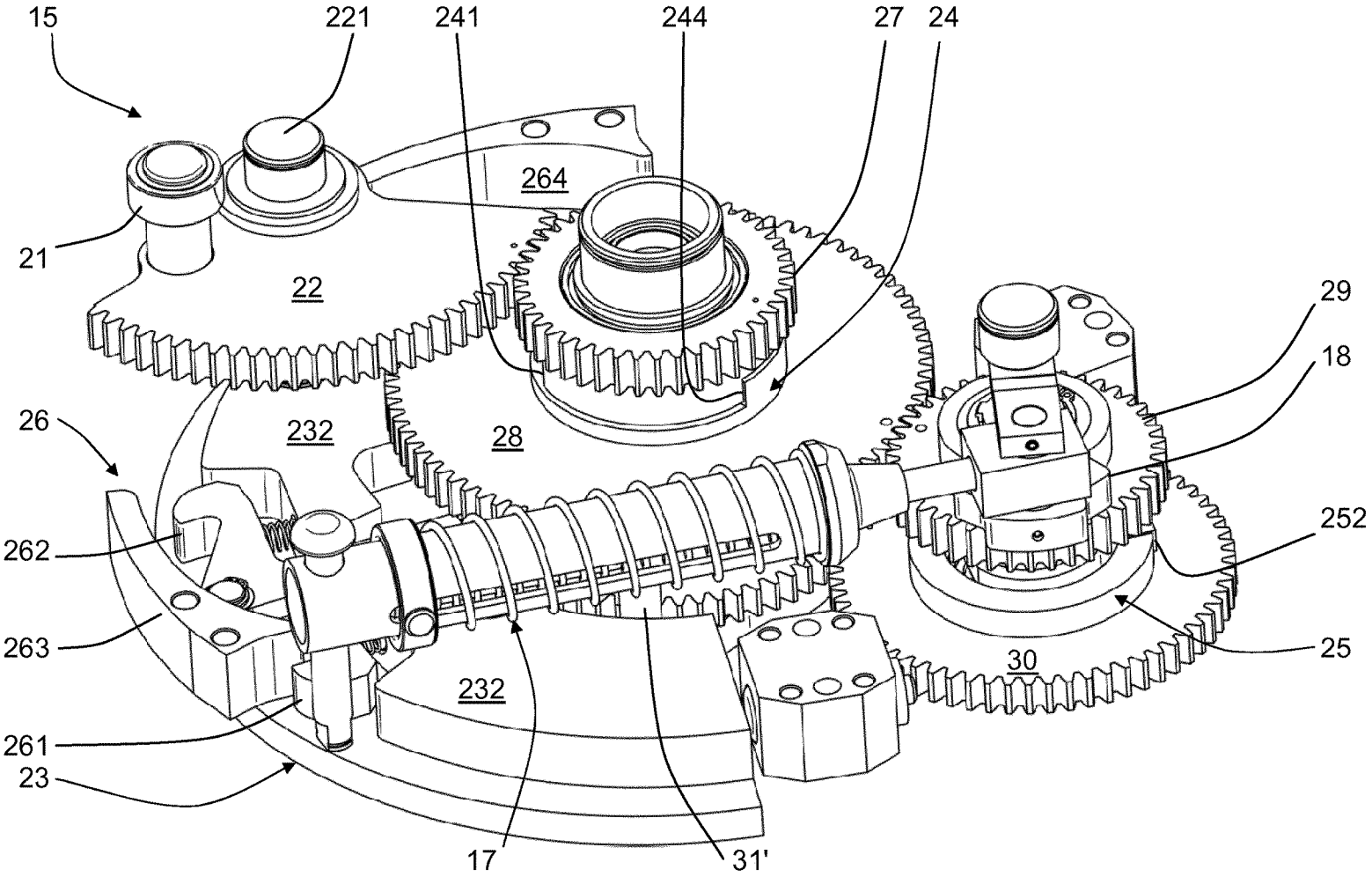
FIG. 5 a fourth view of the force-storage unit from FIG. 2.

The first coupling 24 (FIG. 7) comprises a first coupling claw 24' with a first and second stop surface 241 (FIG. 5, 6), 242 and a second coupling claw 24" with a third and fourth stop surface 243, 244 (FIG. 5). The first coupling claw 24' is fastened to the underside of the "A" gear 27 and the second coupling claw 24" to the upper side of the "B" gear 28.

The first coupling 24 operates in the following manner: When the "A" gear 27 is rotated clockwise out of the position shown in FIG. 5, then the first coupling claw 24' of FIG. 7 is also rotated clockwise. FIG. 7 shows an intermediate position where the stop surface 241 is not yet in contact with stop surface 243, and second coupling claw 24" and "B" gear 28 thus remain in their position. As soon as "A" gear 27 and coupling claw 24' have rotated so far that stop surface 241 is in contact with stop surface 243, the "B" gear 28 is driven along by way of coupling claw 24" upon further rotation, and it is also rotated clockwise out of the position shown in FIG. 5. When "A" gear 27 is then rotated counterclockwise, coupling claw 24' is rotated counterclockwise as well, with stop surface 242 initially not yet being in contact with stop surface 244 and second coupling claw 24" and "B" gear 28 thus remaining in their position. As soon as "A" gear 27 and coupling claw 24' have rotated so far, that is by the first angular backlash, that stop surface 242 is in contact with stop surface 244, the "B" gear 28 is driven along upon further rotation, and it is rotated counterclockwise as well. When driving the "B" gear 28, the manner of operating is correspondingly reversed.

The second coupling 25 (FIG. 8) comprises a first coupling claw 25' with a first and second stop surface 251 (FIG. 2), 252 (FIG. 2, 5) and a second coupling claw 25" with a third and fourth stop surface 253, 254. The first coupling claw 25' is fastened to the "C" gear 29 and the second coupling claw 25" to the upper side of the "D" gear 30. The operating mode of the second coupling 25 corresponds to that of the first coupling 24.

Figure 4:
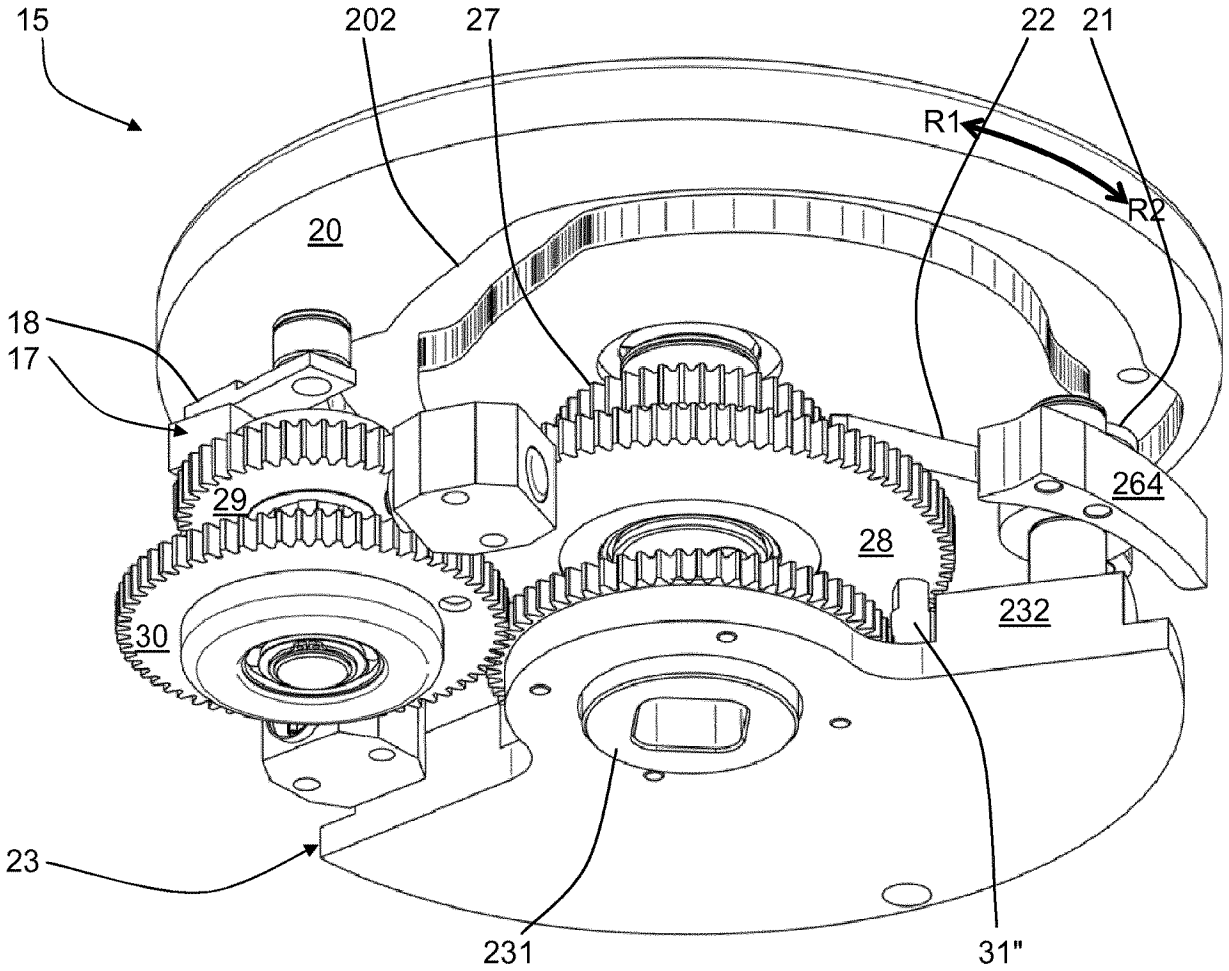
FIG. 4 a third view of the force-storage unit from FIG. 2.
Figure 9:
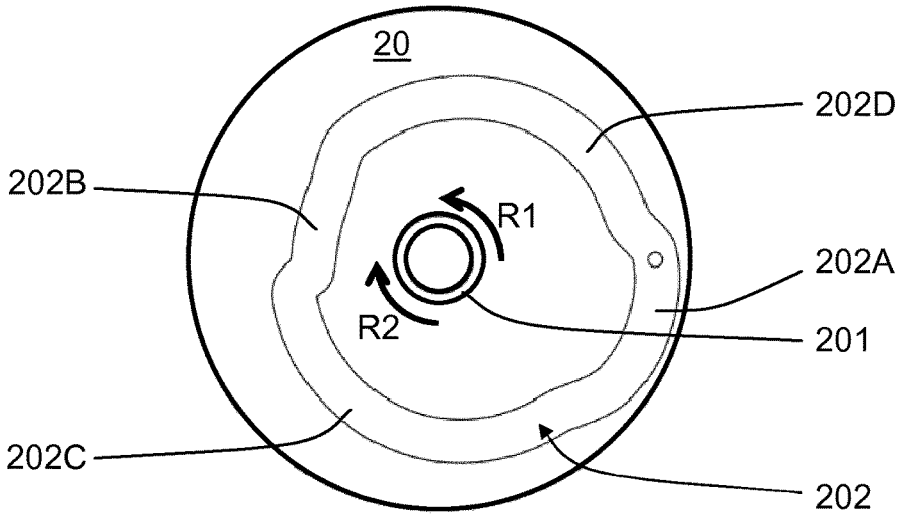
FIG. 9 a bottom view of an exemplary embodiment of a cam disk for the force-storage unit.

FIG. 9 is a bottom view of the cam disk 20 from FIG. 4 with an exemplary embodiment of the cam 202. Cam 202 is in itself closed and has a first section 202A with a constant first radius, a second section 202B with a constant second radius smaller than the first radius, a third section 202C connecting the sections 202A, 202B at their lower ends as seen in FIG. 9 and having a changing radius, and a fourth section 202D connecting the sections 202A, 202B at their upper ends as seen in FIG. 9 and having a changing radius; the radii in this context referring to the input hub 201. Cam 202 thus offers a variable transmission.

The cam transmission forming the variable transmission operates in the following manner: The starting point, as an example, is the "A" basic position shown in FIGS. 3 to 6, where the cam disk 20 takes up the position shown in FIG. 9 that corresponds to a fifth angular position $\alpha5=0°$, cam follower 21 is positioned in section 202A (FIG. 3, 4), stop surface 242 is in contact with stop surface 244 and stop surface 241 is consequently spaced apart from stop surface 243 by the entire first angular backlash, stop surface 252 is in contact with stop surface 254 and stop surface 251 is consequently spaced apart from stop surface 253 by the entire second angular backlash, storage element 17 is relaxed, and pawl 261 is engaged with latching nose 263 and pawl 262 is disengaged. The end point will be a "B" basic position, where the cam disk 20 takes up a fourth angular position $\alpha4=180°$, cam follower 21 is positioned in section 202B, stop surface 241 is in contact with stop surface 243 and stop surface 242 is consequently spaced apart from stop surface 244 by the entire first angular backlash, stop surface 251 is in contact with stop surface 253 and stop surface 252 is consequently spaced apart from stop surface 254 by the entire second angular backlash, storage element 17 is relaxed, and pawl 262 is engaged with latching nose 264 and pawl 261 is disengaged.

When the motor 11 rotates the cam disk 20 in a first direction R1 by way of output shaft 12 and input hub 201 from this "A" basic position and thus from the fifth angular position $\alpha5$ into a first angular position $\alpha1$, then the cam follower 21 first moves in section 202A toward section 202C and then continues as far as into section 202C. Since the radius of cam 202 is constant in section 202A, input gear 22 is not moved, and this corresponds to an infinite transmission of the cam transmission. The transmission thereby blocks the output gear 23 from performing an undesired rotation driven by the input shaft 14. In section 202C, the radius first rapidly decreases; this corresponds to a small transmission. Input gear 22 and "A" gear 27 are consequently rotated fast until the first angular backlash is exhausted in angular position $\alpha1$ such that now stop surface 241 is in contact with stop surface 243 and stop surface 242 is thus now spaced apart from stop surface 244 by the entire first angular backlash. In this rotation from angular position $\alpha5$ to angular position $\alpha1$, "B" gear 28 and the succeeding gear train are consequently not driven so that storage element 17 is not tensioned and output hub 231 stands still.

When the motor 11 rotates the cam disk 20 from angular position $\alpha1$ further in direction R1 up to a second angular position $\alpha2$, then the cam follower 21 continues to move in section 202C toward section 202B. Since the radius in section 202C, however, decreases slower now than before, this corresponds to a greater transmission. Input gear 22 and "A" gear 27 are consequently rotated slower. "B" gear 28, "C" gear 29, and crank 18 are now also rotated by way of the first coupling 24, and storage element 17 is thus tensioned until the storage element 17 is tensioned up to its top dead center in angular position $\alpha2$ and the second angular backlash is exhausted such that now stop surface 251 is in contact with stop surface 253 and stop surface 252 is thus now spaced apart from stop surface 254 by the entire second angular backlash. In this rotation from angular position $\alpha1$ to angular position $\alpha2$, "D" gear 30 and the succeeding gear train are consequently not driven so that output hub 231 stands still. "B" gear 28 advances release bolt 31' up to the stop of the first pawl 261.

Figure 6:
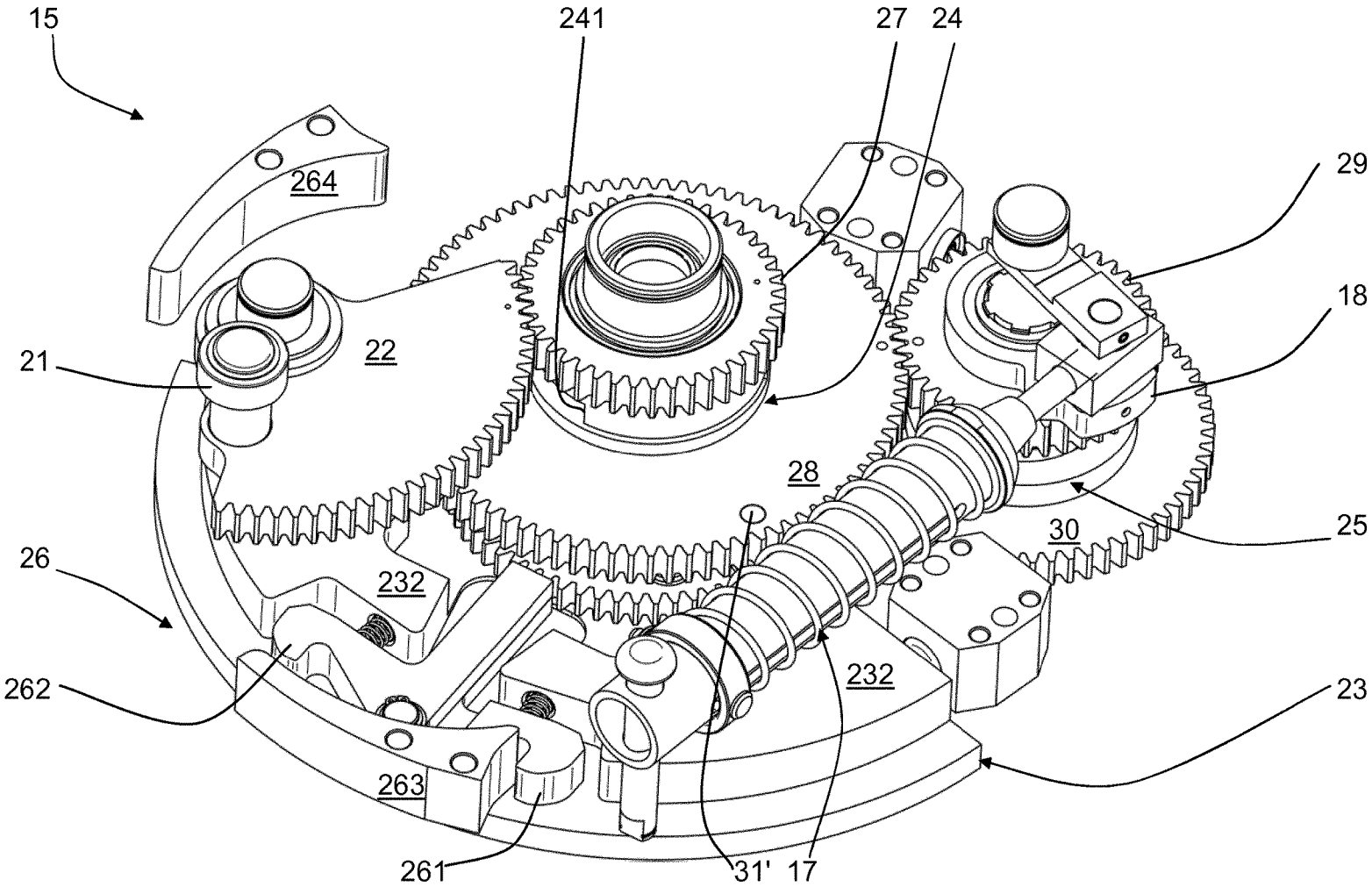
FIG. 6 a fifth view of the force-storage unit from FIG. 2.

When the motor 11 rotates the cam disk 20 from angular position $\alpha2$ further in direction R1 up to a third angular position $\alpha3$, then the cam follower 21 continues to move in section 202C up to section 202B. Release bolt 31' is consequently pressed against pawl 261 by "B" gear 28 and pawl 261 is disengaged from latching nose 263. At the same time, crank 18 presses storage element 17 beyond the top dead center so that storage element 17 relaxes, and output gear 23 meanwhile rotates from the first angular position $\omega1$ shown in FIGS. 2 to 6 into a second angular position $\omega2$. In angular position $\omega1$, the flywheel 232 with its end on the right as seen in FIG. 6 is in contact with a stop block in front as seen in FIG. 6, which stop block is fastened to the underside of the lower frame plate 19". In angular position $\omega2$, the flywheel 232 with its end on the left as seen in FIG. 6 is in contact with a stop block in the back as seen in FIG. 6, which stop block is fastened to the underside of the lower frame plate 19", pawl 262 is engaged with latching nose 264, and pawl 261 is disengaged.

When the motor 11 rotates the cam disk 20 from angular position $\alpha3$ further in direction R1 up to a fourth angular position $\alpha4$ that corresponds to the "B" basic position, then the cam follower 21 moves into section 202B. Since the radius of cam 202 is constant in section 202B, input gear 22 is not moved, and this corresponds to an infinite transmission of the cam transmission. The transmission thereby blocks the output gear 23 from performing an undesired rotation driven by the input shaft 14.

The cam 202 is exemplarily formed such that each of the particular movements of the input gear 22 run oppositely to each other, both upon the previously explained rotation of the input hub 201 in the first direction R1 from angular position α5 into angular position α4 and upon a further rotation of the input hub 201 in an opposite, second direction R2 from the angular position α4 back into the angular position α5; and each of the particular movements of the input gear 22 run oppositely to each other, both upon the previously explained rotation of the input hub 201 in direction R1 from angular position α5 into angular position α4 and upon a further rotation of the input hub 201 from the angular position α4 in direction R1 by the same differential angle that here exemplarily is α4-α5=180°.

In the normal case, the storage element 17 relaxes so rapidly and with such a force that the "C" gear 29 rotates so fast that it rotates the "B" gear 28 faster than the input gear 22 rotates the "A" gear 27. The stop surface 241 consequently departs from the stop surface 243 so that coupling 24 runs freely again. In order to be able to attain a re-pressing of the output gear 23 by the motor 11 as promptly as possible in the instance that the storage element 17 cannot rotate the output gear 23 fast enough, the radius returns to decreasing quicker in section 202C; and this implies a smaller transmission and faster rotation of input gear 22 and output gear 23. In this case, the transmission, either together with the storage element 17 or even instead of the storage element 17, can consequently rotate the output gear 23 by means of the motor 11 from angular position ω1 or from an intermediate angular position between angular position ω1 and angular position ω2, into the angular position ω2.

Figure 10:
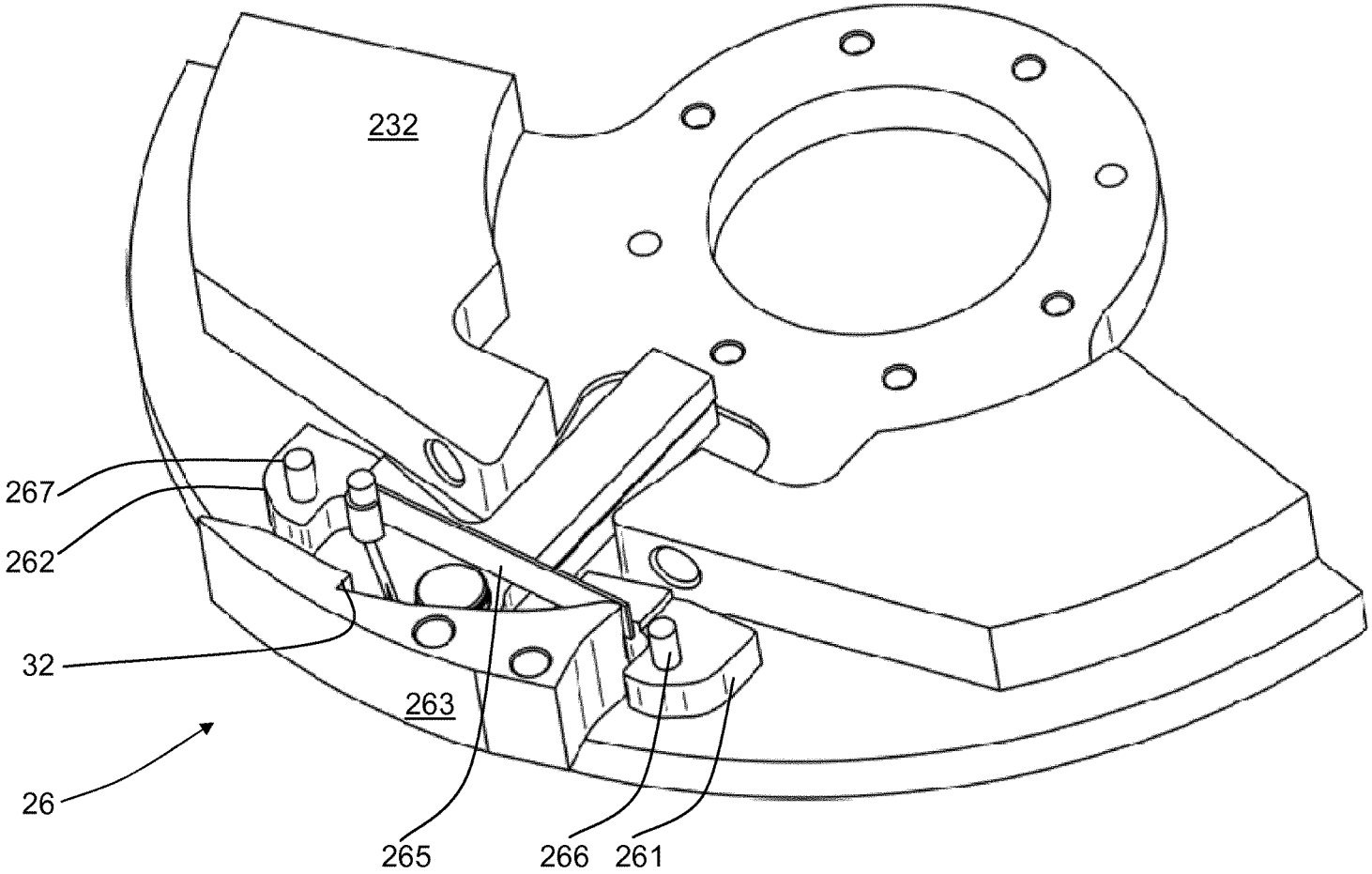
FIG. 10 a second embodiment of the locking mechanism.

A second embodiment of the locking mechanism 26 is schematically illustrated in FIG. 10. As this embodiment is similar to the first embodiment, primarily the differences will be explained in more detail in the following passages. Latching nose 264 is formed in analogy to latching nose 263 and is not illustrated.

In this embodiment, the first latching nose 263 has an intermediate latching surface 32 located on its contact surface between its latching surface and its opposite end, which intermediate surface is seized by the pawl 261 with its pawl claw when the output gear 23 upon rotation from angular position ω1 into angular position ω2 reaches a corresponding intermediate angular position between this angular positions ω1,ω2. The locking mechanism 26 consequently prevents the output gear 23 from being able to depart from this intermediate angular position toward its first angular position ω1.

In this embodiment, the locking mechanism 26 comprises a first spring plate 265 assigned to the latching nose 263, a second spring plate (not illustrated) assigned to the latching nose 264, and two guide pins 266, 267 assigned to the pawls 261, 262. The first spring plate 265 is fastened with a fixed end (on the left in FIG. 10) radially within its latching nose 263 to the underside of the lower frame plate 19", and with its other, free end (on the right in FIG. 10), it presses radially outward against the connecting edge between contact surface and latching surface. The fixed end is located in the area of the intermediate latching surface 32. Each guide pin 266, 267 is fastened on the upper side of the pawl claw of its particularly assigned pawl 261, 262. When the pawl 261 engages, the guide pin 266 is guided from left to right in FIG. 10 in the intermediate space between spring plate 265 and latching nose 263 until the output gear 23 has reached its second angular position ω2 shown in FIG. 10, where the pawl 261 is engaged and the guide pin 266 has departed from the intermediate space. Upon disengaging, the guide pin 266 is moved radially inward past the free end of the spring plate 265, and upon further rotation of the output gear 23 toward the first angular position ω1, it slides from right to left in FIG. 10 along the side of the spring plate 265 that is turned away from the latching nose 263, and it prevents the pawl 261 from being able to seize the intermediate latching surface 32 with its pawl claw. The locking mechanism 26 consequently prevents the output gear 23 from being prone to remain or get caught or stuck in this intermediate angular position upon rotation of the output gear 23 from the angular position ω2 into the angular position ω1.

Figure 11:
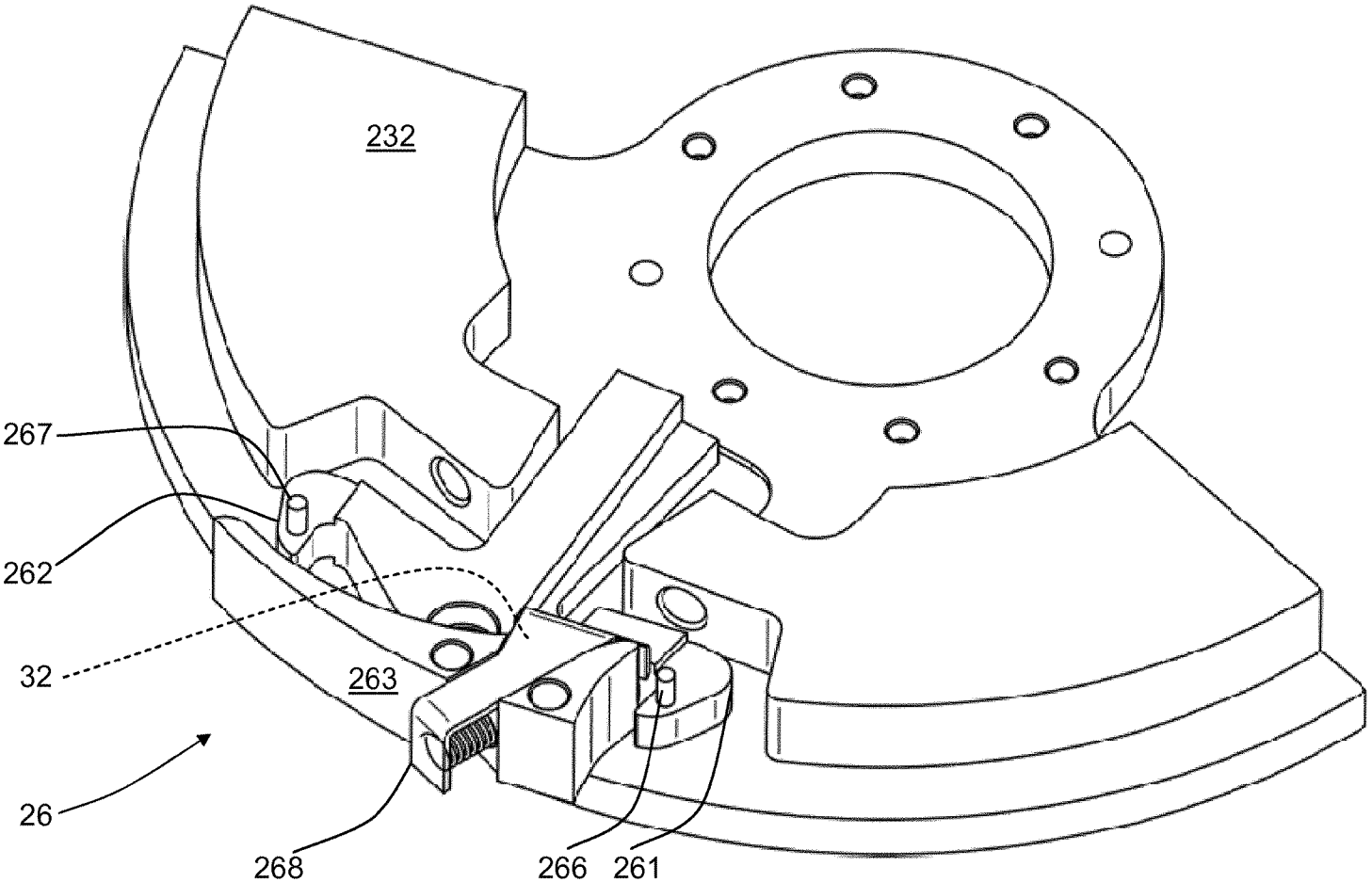
FIG. 11 a third embodiment of the locking mechanism.

A second embodiment of the locking mechanism 26 is schematically illustrated in FIG. 11. As this embodiment is similar to the second embodiment, primarily the differences will be explained in more detail in the following passages. Latching nose 264 is formed in analogy to latching nose 263 and is not illustrated.

In this embodiment, the locking mechanism 26 comprises a first cover part 268 assigned to the latching nose 263 and a second cover part (not illustrated) assigned to the latching nose 264 instead of the spring plates 265, 266. In comparison to the second embodiment, the intermediate latching surface 32 is located closer to the latching surface and is not discernible, because it is concealed by the cover part 268. By means of a preload spring that supports itself at the radially outer surface of the latching nose 263, the cover part 268 is preloaded with its right end as seen in FIG. 11 radially outwardly against the connecting edge between contact surface and latching surface. With its other end on the left in FIG. 11, the cover part 268 is located spaced apart from the latching nose 263. When the pawl 261 engages, the guide pin 266 is guided from left to right in FIG. 11 in the intermediate space between cover part 268 and latching nose 263 until the output gear 23 has reached its second angular position ω2 shown in FIG. 11, where the pawl 261 is engaged and the guide pin 266 has departed from the intermediate space. Upon disengaging, the guide pin 266 is moved radially inward past the free end of the cover part 268, and upon further rotation of the output gear 23 toward the first angular position ω1, it slides from right to left in FIG. 11 along the side of the cover part 268 turned away from the latching nose 263, and it prevents the pawl 261 from being able to seize the intermediate latching surface 32 with its pawl claw. The locking mechanism 26 consequently prevents the output gear 23 from being prone to remain or get caught or stuck in this intermediate angular position upon rotation of the output gear 23 from the angular position ω2 into the angular position ω1.

The invention claimed is:

1. In combination with an on-load tap changer having a motor with an output shaft and a load diverter switch with an input shaft, an energy accumulator comprising an elastic storage element;

a drive train coupled to the storage element and having an input hub that can be rotationally fixed to the output shaft;

an output hub that can be rotationally fixed to the input shaft;

a variable transmission interposed between the input hub and the storage element;

a first coupling that has a predetermined first angular backlash and that is between the input hub and the storage element; and a second coupling that has a predetermined second angular backlash and that is between the storage element and the output hub.

2. The energy accumulator according to claim 1, further comprising a tensioning and relaxing element in operative engagement with the storage element for tensioning the storage element upon rotation of the input hub and for driving the output hub upon relaxation of the storage element, the drive train being formed such that it rotates with the tensioning element at a specified velocity upon relaxation of the relaxing element; and/or restresses the relaxing element on relaxation of the relaxing element.

3. The energy accumulator according to claim 1, wherein the drive train is formed so as to tension the storage element upon rotation of the input hub in a first direction from a predetermined first angular position into a predetermined second angular position, while the output hub is stationary; and the storage element is formed so as to relax upon rotation of the input hub in the first direction from the second angular position into a predetermined third angular position, and the output hub meanwhile rotates from another first angular position into another second angular position.

4. The energy accumulator according to claim 3, wherein the drive train is formed such that the transmission ratio of the variable transmission upon rotation of the input hub in the first direction from the second into the third angular position is smaller than during tensioning.

5. The energy accumulator according to claim 3, wherein the drive train is formed such that the transmission ratio of the variable transmission upon rotation of the input hub in the first direction from the first into the second angular position is greater than a specified threshold value; and the transmission ratio of the variable transmission upon rotation of the input hub in the first direction from the second into a third angular position is smaller than the threshold value.

6. The energy accumulator according to claim 3, wherein the drive train and the storage element are formed such that together they rotate or can rotate the output hub from the first angular position or from an intermediate angular position between the first and second angular positions, into the second angular position upon rotation of the input hub in the first direction from the second angular position into the third angular position;

and/or the drive train is formed such that instead of the storage element, the drive train rotates or can rotate the output hub from the first angular position or from an intermediate angular position between the first and second angular positions, into the second angular position upon rotation of the input hub in the first direction from the second into the third angular position.

7. The energy accumulator according to claim 3, wherein the drive train is formed so as to prevent the output hub from being able to depart from the second angular position by more than a specified deviation angle upon rotation of the input hub in the first direction and between the second and third angular positions.

8. The energy accumulator according to claim 3, wherein the drive train comprises a locking mechanism coupled to the output hub and formed so as to prevent the output hub from being able to depart from the second angular position by more than the deviation angle and/or toward the first angular position upon rotation of the input hub in the first direction and between the second and third angular positions;

prevent the output hub from being able to depart from the second angular position toward the first angular position when the output hub is in the second angular position;

prevent the output hub from being able to depart from an intermediate angular position toward the first angular position when the output hub is in the intermediate position between the first and second angular position;

prevent the output hub from remaining in the intermediate angular position upon rotation of the output hub from the second into the first angular position.

9. The energy accumulator according to claim 3, wherein the drive train comprises a release mechanism formed so as to release the locking mechanism upon rotation of the input hub in the first direction and in the second angular position or between the second and third angular positions.

10. The energy accumulator according to claim 3, wherein the drive train is formed so as to block the output hub upon rotation of the input hub in the first direction from the third angular position into a predetermined fourth angular position.

11. The energy accumulator according to claim 10, wherein the drive train is formed so as not to tension the storage element upon rotation of the input hub in the first direction from a predetermined fifth angular position before the first angular position, into the first angular position, while the output hub is stationary.

12. The energy accumulator according to claim 11, wherein the drive train comprises a cam disk having a cam and the input hub;

a cam follower that follows the cam and that is formed such that each of the movements of the cam follower run synchronously oppositely to each other upon rotation of the input hub in the first direction from the fifth into the fourth angular position and upon rotation of the input hub in an opposite second direction from the fourth into the fifth angular position; and/or the cam is formed such that each of the movements of the cam follower run synchronously oppositely to each other upon rotation of the input hub in the first direction by a differential angle from the fifth into the fourth angular position and upon rotation of the input hub in the first direction by the same differential angle from the fourth angular position; and/or the cam is in itself closed; and/or the cam is formed such that the differential angle between the fourth and fifth angular positions is 180° or 90° or 60° or 45° or a whole-number fraction of 180°.

* * * * *